United States Patent [19]

McStravick et al.

[11] 4,210,207

[45] Jul. 1, 1980

[54] VALVE APPARATUS

[75] Inventors: David M. McStravick, Houston; William M. Roberts, Deer Park, both of Tex.

[73] Assignee: Baker International Corporation, Orange, Calif.

[21] Appl. No.: 20,307

[22] Filed: Mar. 14, 1979

[51] Int. Cl.[2] ..... E21B 43/12

[52] U.S. Cl. ..... 166/330; 251/251; 251/352

[58] Field of Search ..... 166/330, 331; 251/228, 251/251, 259

[56] References Cited

U.S. PATENT DOCUMENTS

| | | | |
|---|---|---|---|
| 3,386,701 | 6/1968 | Potts | 166/330 |
| 4,130,166 | 12/1978 | Akkerman et al. | 166/330 |

*Primary Examiner*—James A. Leppink

*Attorney, Agent, or Firm*—William C. Norvell, Jr.

[57] ABSTRACT

A valve apparatus is provided for use in a subterranean well and is responsive to manipulation of a fluid transmission conduit to manipulate a valve head relative to a valve seat between open and closed positions, the valve head means comprising camway slot means defined exteriorly thereon. Camway ball means are secured to the valve seat means and carriable in the camway slot means to pivot the valve head means as the head is rotated relative to its seat.

8 Claims, 12 Drawing Figures

VALVE APPARATUS

BACKGROUND OF THE INVENTION

1. Field of the Invention

The invention relates to a valve apparatus which may be utilized in a fluid transmission conduit of a subterranean well to isolate fluid flow passing therethrough.

2. Description of the Prior Art

It frequently is necessary to isolate flow of fluids within a fluid transmission conduit, such as a tubing string in a subterranean well. The prior art is familiar with many varied designs of valves, particularly "safety" valves that utilize a ball having a flow passageway therethrough as the valve head. Such valves have been found to be particularly reliable in subterranean well applications.

Ball valves have a camway slot defined on the exterior thereon for receipt of a ball or bearing element therein which is secured to the valve seat or other means have been utilized to pivot the ball relative to the seat of the valve in response to hydraulic activation and incorporation of piston means. Oftentimes, it is desirable to provide a ball valve apparatus which is not responsive to hydraulic activation, but which is directly responsive to mechanical manipulation of the fluid transmission conduit, such that, for example, the valve may be activated before and/or after the setting or release of another tool, such as a packer, bridge plug, or the like.

The present invention provides a valve apparatus which comprises such a valve head and seat configuration, but which is responsive to fluid conduit mechanical manipulation to activate the valve and shift it between open and closed positions.

SUMMARY OF THE INVENTION

A valve apparatus is provided for use in a subterranean well and is responsive to manipulation of a fluid transmission conduit to manipulate a valve head relative to a valve seat between open and closed positions, the valve head means comprising camway slot means defined exteriorly thereon. Camway ball means are secured to the valve seat means and carriable in the camway slot means to pivot the valve head means as the head is rotated relative to its seat.

DESCRIPTION OF THE PREFERRED EMBODIMENTS

Figure 1:
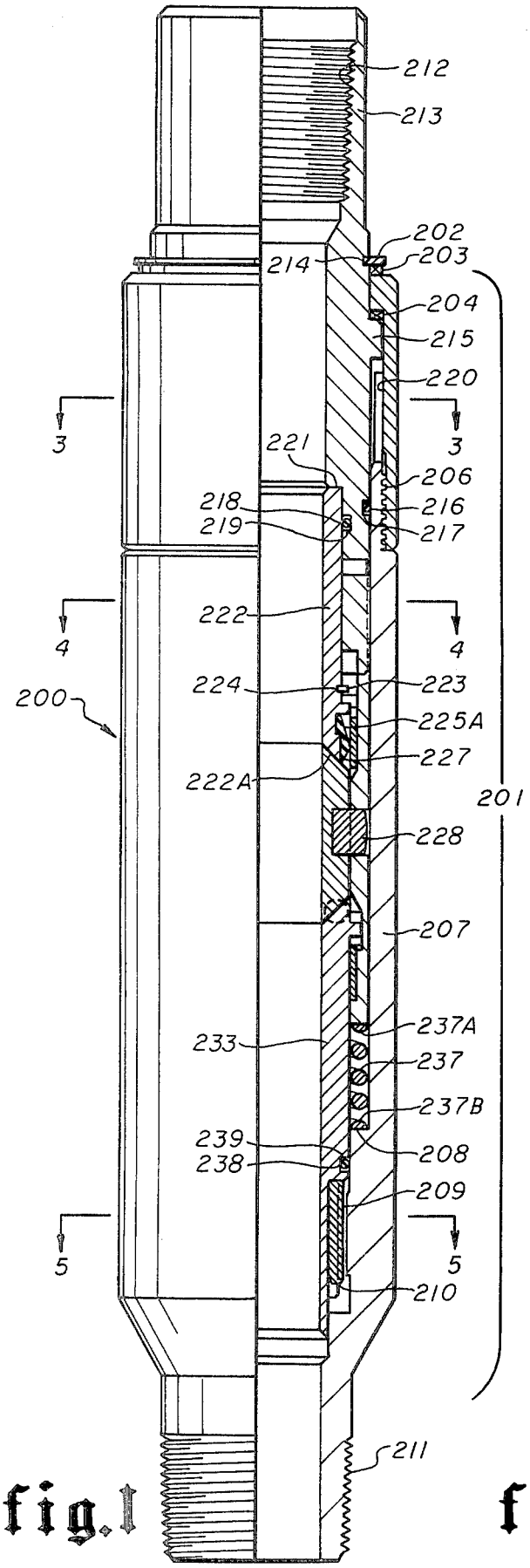
FIG. 1 is an enlarged sectional view of the valve apparatus of the present invention in open position.
Figure 2:
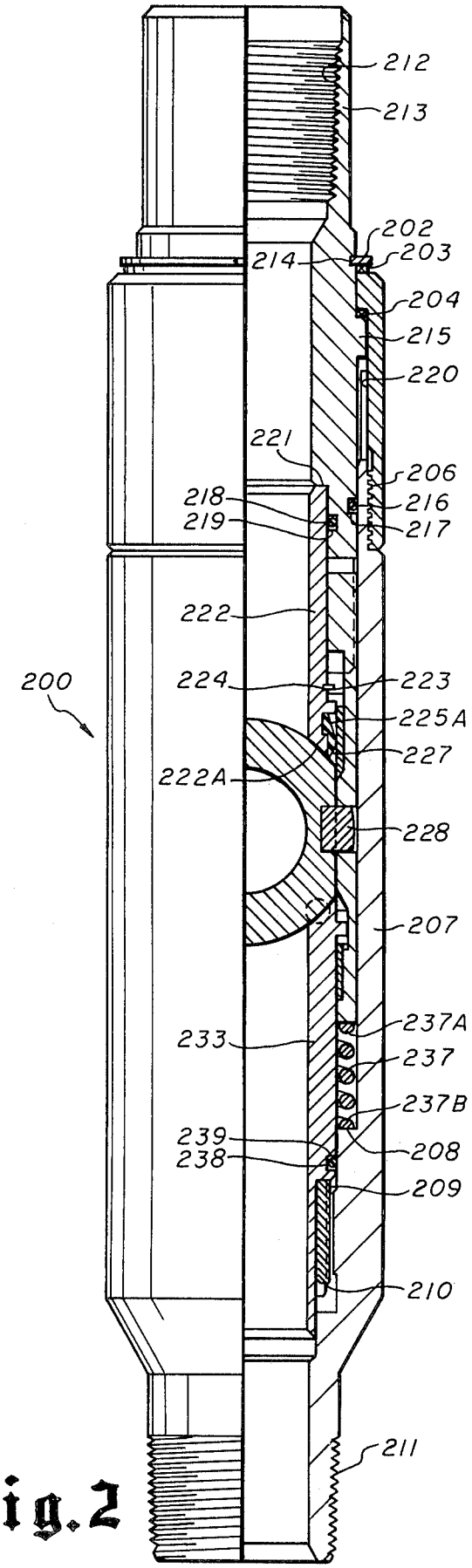
FIG. 2 is a view similar to that shown in FIG. 1, but illustrating the valve apparatus subsequent to shifting to the closed position.

Referring to FIGS. 1 and 2, a valve apparatus 200 is illustrated with threads 212 at its uppermost end for affixation to the lower end of a tubular member (not shown). The valve apparatus 200 has an outer housing 201 which generally consists of a bearing retainer 205 at its uppermost end which is connected by threads 206 to a lower housing 207 therebelow.

Above the bearing retainer 205 are upper and lower bearing assemblies 203 and 204, respectively, the upper bearing assembly 203 being supported in position by a circumferentially extending arc ring 202 held in place upon a top sub member 213 and within a grooveway 214. The bearings 203 and 204 may be teflon-fabricated coated elements which permit rotation of the top sub 213 relative to the outer housing 201 without excessive friction.

Figures 7, 9, 11:
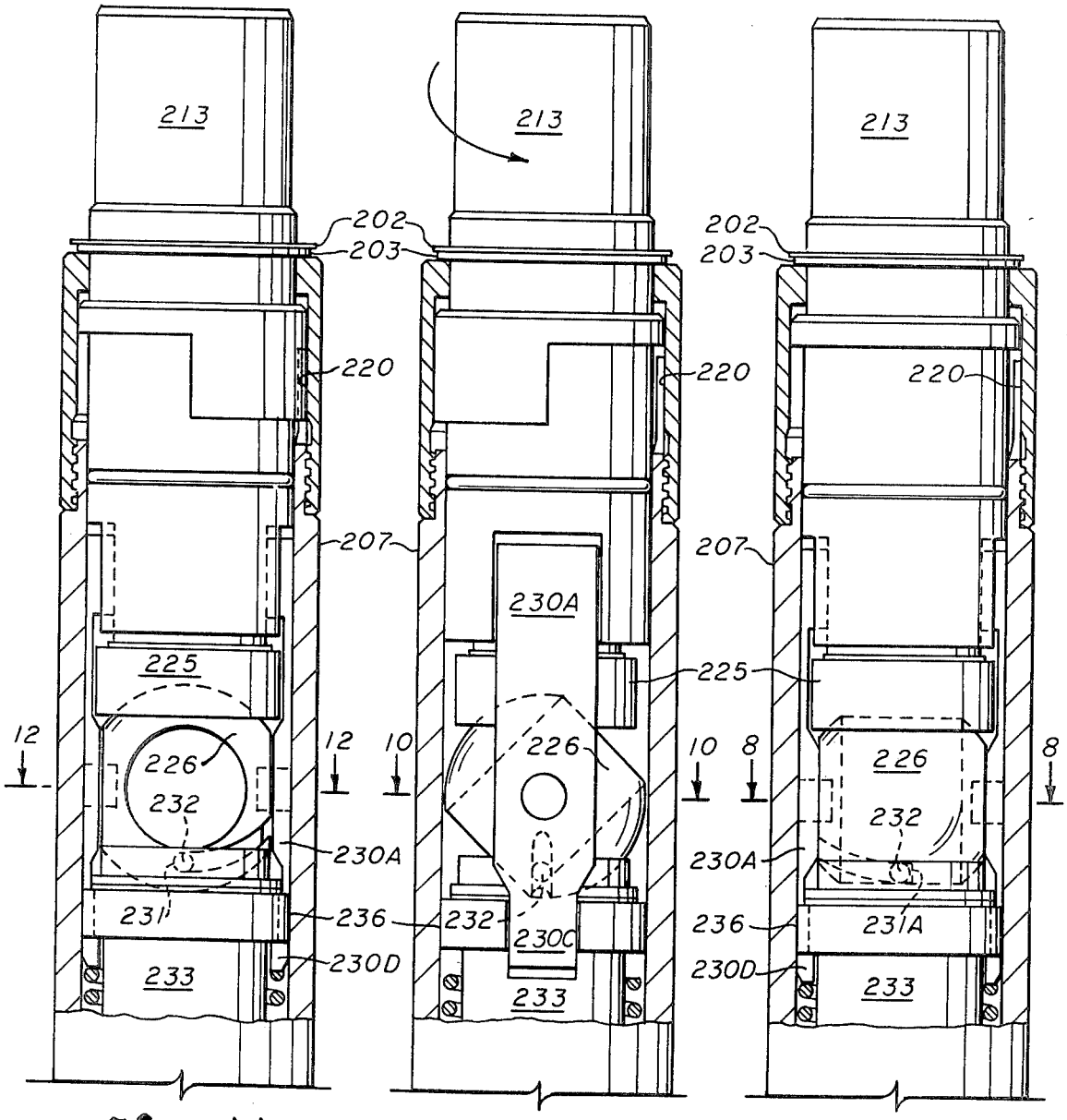
FIG. 7 is an enlarged view of the valve apparatus of the present invention with the ball illustrated in open position.
FIG. 9 is an enlarged sectionalized illustration of the valve apparatus of the present invention shifting from the open position shown in FIG. 7 to the closed position shown in FIG. 11.
FIG. 11 is an enlarged sectional elongate view of the valve apparatus of the present invention illustrating the valve when the ball member is shifted to the closed position.
Figures 8, 10, 12:
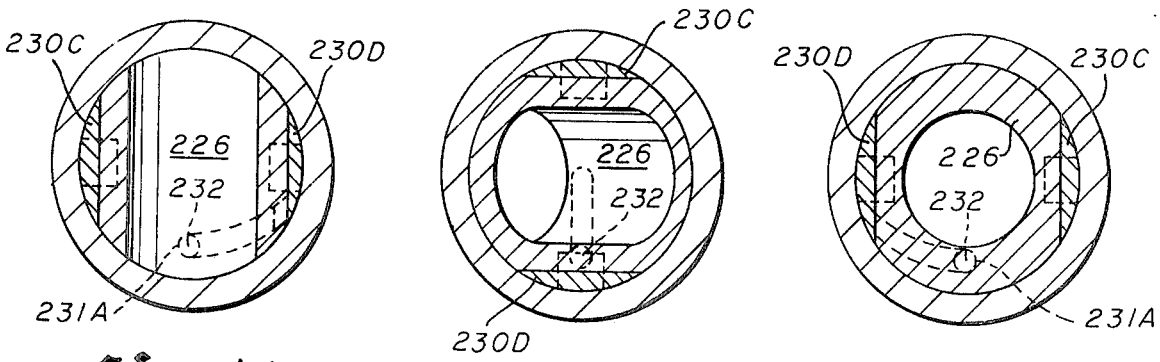
FIG. 8 is a cross-sectional view taken along Lines 8—8 of FIG. 7.
FIG. 10 is a cross-sectional view taken along Lines 10—10 of FIG. 9.
FIG. 12 is a cross-sectional view taken along Lines 12—12 of FIG. 11.

The lower housing 207 has defined inwardly thereon a shoulder 208 for receipt of the lower end 237B of a helical compression spring 237. Also at the lower portion of the lower housing 207 and as particularly depicted in FIG. 7, are a pair of keys 209 interengaged between the lower housing 207 and the follow sleeve 233. Each key 209 is lodged within a recess 210 spaced 180° apart from one another. This key and recess system 209–210 permits locking interengagement between the follow sleeve 233 and the lower housing 207 and thereby prevents rotational movement therebetween during manipulation of the ball element 226.

At the lowermost end of the lower housing 207 is a series of threads 211 for connection of the valve apparatus 200 to the upper end of another tubular member (not shown) in a fluid transmission conduit.

Interior of the outer housing 201 is a top sub 213 having the threads 212 defined thereon at its uppermost end and the grooveway 214 defined circumferentially around the exterior of the uppermost end of the top sub 213 for receipt of the inner portion of the arc ring 202. An extension shoulder 215 also is defined on the top sub 213 for transmission of tensil forces through the apparatus 200. A circumferentially extending elastomeric O-ring seal element 216 is defined circumferentially within a grooveway 217 therefor on the top sub 213 to prevent fluid communication between the top sub 213 and the lower housing 207. Similarly, a ring 218 within a companion groove 219 also is defined on the top sub 213 to prevent fluid communication between the top sub 213 and a ball seat sleeve 222 carried therebelow.

Figure 3:
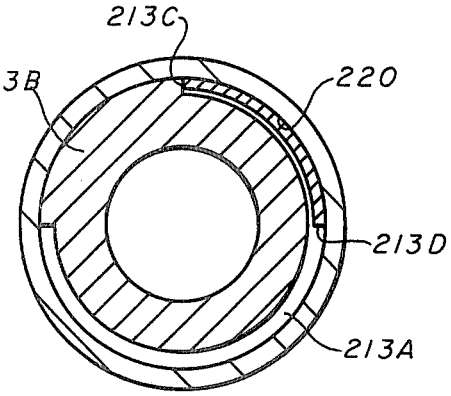
FIG. 3 is a cross-sectional view taken along Lines 3—3 of FIG. 1.

Now referring to FIG. 3, a rotation lock 220 is carried by the lower housing 207 and within a slot 213A defined between the retainer 205 and the top sub 213 to permit lefthand rotation of the top sub 213 and the ball seat sleeve 222 to rotate the ball 226 from open to closed position prior to clutch engagement between the top sub 213 and the lower housing 207 to transmit the rotational force from the tubing through the top sub 213 to the outer housing 201 to, for example, retrieve a well packer assembly (not shown) therebelow. The rotation lock 220 illustrated in FIG. 3 is a portion of a clutch assembly which has an arresting stop element 213B defined as a portion of the top sub 213, the rotation lock 220 having first and second stop ends 213C and 213D for checking the rotational travel of the top sub 213 and for selective carriage of the outer housing 201 rotatably therewith.

The top sub 213 also defines an inwardly extending lowerly facing shoulder element 221 for interface with the upper end of a longitudinally extending cylindrical ball seat sleeve 222 therebelow.

Figure 6:
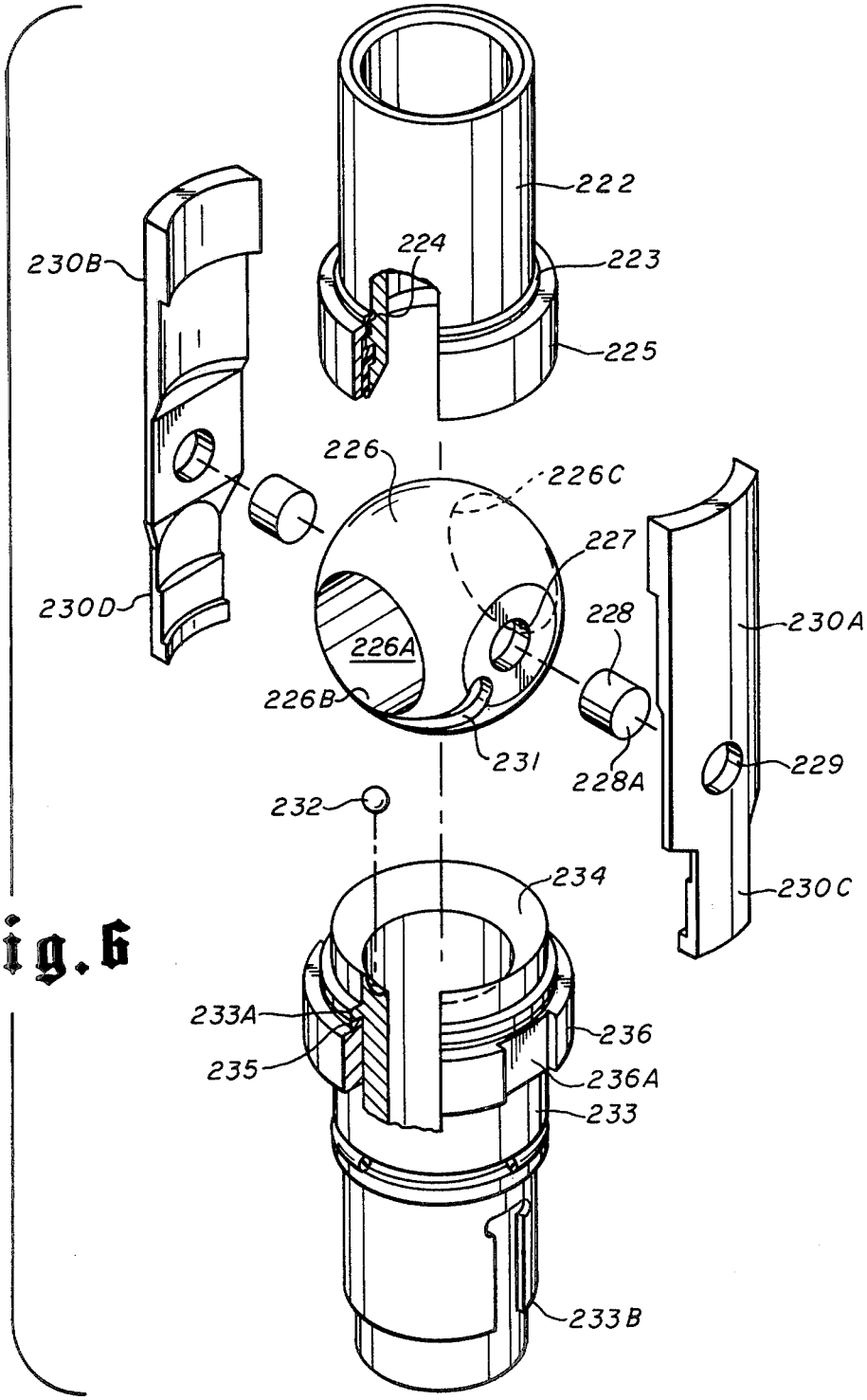
FIG. 6 is a dimensionalized illustration of the component parts of the ball valve, ball seat and ball cage arms, as shown in FIGS. 1, 2, 7, 9 and 11.

Now referring to FIG. 6, the ball seat sleeve 222 has defined thereon an exteriorly facing groove 224 for engagement of a ring 223 carried therearound, the ring 223 securing a resilient seal retainer 225 housed interiorly at the lowermost end of the ball seat sleeve 222, the retainer 225 providing a portion of a housing for a resilient seal 225A (FIG. 1), made of an elastomeric material, the smooth lower end or face 227 of the seal 225A sliding along the outer peripheral surface of the ball 226 during pivotal rotation.

With continued reference to FIG. 6, a spherical ball element 226 has a central passageway 226A therethrough, the passageway 226A terminating at each end of the ball 226 by open end 226B and open end 226C, the passageway 226A communicating with the upper and lower interior of the valve assembly 200 for selective transmission of the salt water injection or other fluid. The ball 226 has transversely defined immediate the passageway 226A circular trunion sockets 227, each socket 227 being defined 180° relative one to another across the outer face of the ball 226, each trunion socket receiving a trunion pin 228 having its end 228A received within a trunion hole 229 defined within elevated first and second cage arms 230A and 230B, respectively.

The ball 226 also has defined exteriorly thereon a camway 231 for relative travel of a camway ball 232 which is slidably manipulatable thereon. The camway 231 is machined on the periphery of the ball 226 in a plane cutting through the axis of the pins 228 and at a 45° angle to the open ends 226B and 226C defining the ends of the passageway 226A through the ball 226. The camway 231 extends on one end to at least the plane of a diameter cut through the center of the ball 226 at right angles to the trunion pins 228, and on the other end to a point such that a line through this point to the center of the ball 226 would make an angle somewhat less than 45° with the axis of the trunion pins. The cosine of the angle of rotation of the ball seal sleeve 222 is equal to the tangent of an angle equal to 45° minus the angle of the rotation of the ball 226.

In the position shown as in FIGS. 7 and 11, the distance from the center of the camway ball 232 to a plane passing through the trunion pins 228 and a center line of the valve assembly 200 is a maximum and is equal to the vertical distance from the center line of the trunion pins 228 to the camway ball 232. Now when the ball seal sleeve 222 is rotated 90°, the above mentioned vertical distance remains constant, but the distance to the center line decreases to zero. This configuration is shown in FIG. 9. It can be seen that the only time a point on the camway 231 can also have a zero distance from the center line is when the plane of the camway 231 coincides with the plane through the trunions 228 and the center line of the valve assembly 200. In other words, when the ball seal sleeve 222 is rotated 90°, the ball 226 pivotally rotates 45° and would be half open, as is illustrated in the position shown in FIG. 9. To fully open the ball 226 or turn it 90°, the ball seal sleeve must be rotated 180°.

Figure 4:
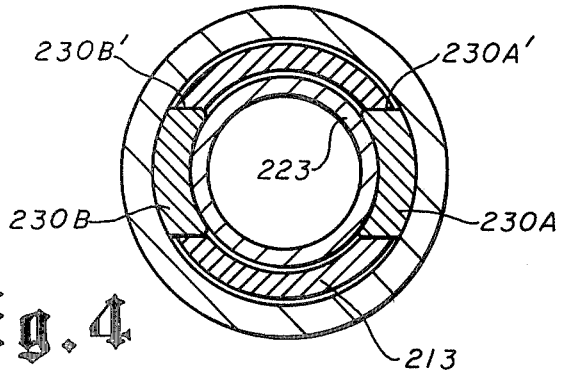
FIG. 4 is a cross-sectional view taken along Lines 4—4 of FIG. 1.
Figure 5:
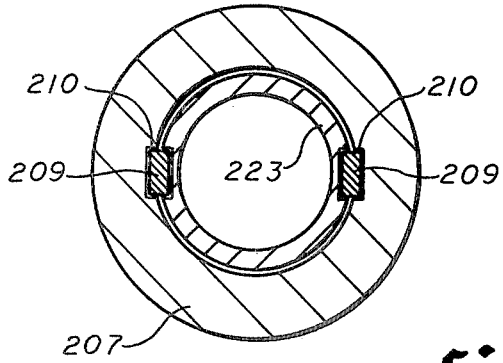
FIG. 5 is a cross-sectional view taken along Lines 5—5 of FIG. 1.

The upper end of each cage arm 230A and 230B are received between cage arm receiving slots 230A' and 230B' defined on the lower periphery of the top sub 213 to enable rotational movement through the top sub 213 to the arms 230A and 230B to rotate the ball 226, as shown in FIG. 4.

In FIG. 6, the cage arms 230A and 230B have defined below the hole 229 at the lowermost end thereof an arm sleeve section 230C and 230D, respectively, which is secured within the respective slips 236A defined within the follow sleeve 233, each slip 236A being 180° apart and defined within a cage support ring 236 carried exteriorly of the follow sleeve 233. A cage bearing 235 is carried above the support ring 236 and below an extending outward shoulder 233A on the follow sleeve 233, the cage bearing 235 permitting rotation between the cage arms 230A, 230B and the cage support ring 236, and the follow sleeve 233. The lower end 233B of the follow sleeve 233 has an elastomeric O-ring seal element 238 carried within a circumferentially extending exterior grooveway 239 thereon to prevent fluid communication between the follow sleeve 33 and the lower housing 207.

At the uppermost end of the follow sleeve 233 is a beveled metallic ball seat 234 for interface around the outer periphery of the ball 226 as the ball 226 is pivoted and rotated with respect to the follow sleeve 233 during manipulation between opened and closed positions. The ball seat 234 also houses in affixed relation to the follow sleeve 233 a camway ball or bearing 232 which is snuggly engaged for travel within and along the camway 231 of the ball 226. Preferably, the camway ball 232 is made of a hard material, such as tungsten carbide or hardened steel.

As shown in FIG. 7, the camway 231 has a terminal 231A which interfaces with the camway ball 232 when the ball 226 is in the fully open position and acts as a stop against further rotation. The terminal 231A interfaces with the camway ball 232 when the ball 226 is pivotally rotated to the completely closed and open positions, the interface of the terminal 231A and the camway ball 232 preventing further rotational pivoting of the ball 226.

As shown in FIGS. 1 and 2, a spring 237 is housed between the follow sleeve 233 and the lower housing 207 with the upper end 237A of the spring 237 urging against the cage arms 230, and the lower end 237B of the spring 237 resting against a shoulder 208 on the lower housing 207. The spring 237 causes the ball 226 to engage the resilient seal 225A.

It should be noted that when the fluid transmission conduit is rotated, the top sub 213 will rotate correspondingly and will, in turn, rotationally carry the cage arms 230A and 230B which, in turn, permit the trunion pins 228 to rotate the ball 226, the cage arms 230A and 230B being supported by the top sub 213 thereabove and therebelow by means of the cage support ring 236. As the cage arms 230A and 230B rotate the respective trunion pins 228 to rotate the ball 226, the relative travel of the camway ball 232 within the camway 231 causes the ball 226 also to pivot, thus pivotably rotating the ball 226 between open and closed positions, the follow sleeve 233 remaining in stabilized position relative to the travel of the cage arms 230A and 230B.

OPERATION

Assuming that the valve apparatus 200 is initially in the open position, to manipulate it to the closed position, the fluid transmission conduit is rotated to cause a 180° rotation at the valve apparatus 200. Now referring to FIGS. 6 through 12, as the conduit is rotated to the left, such lefthand rotation is carried through the valve apparatus 200 through the top sub 213 and to the ball seal sleeve 222 interconnected therewith. However, the outer housing 201 will not be caused to rotate because of the free play afforded by the bearings 203 and 204 in conjunction with the positioning of the rotation lock 220 around the slot 213A. The outer housing 201 will not rotate until such time as the arresting stop 213B moves from the stop end 213C to the stop end 213D. It should be noted that the travel distance between the end 213C of the rotation lock 220 and the end 213D of the rotation lock 220 is sufficient to permit the arresting stop 213B and the top sub 213, together with the ball seat sleeve 222, to travel 180°.

As the top sub 213 is rotated to the left, each of the cage arms 230A and 230B are also caused to travel therewith and to rotate the ball 226. Such lefthand rotation of the ball 226, in conjunction with the positioning of the camway ball 232 within the camway 231, permits the ball 226 to rotationally pivot until such time as the camway ball 232 moves relatively away from the terminal 231A, and thereafter returns toward terminal 231A, thereby isolating the passageway 226A within the ball 226 from the interior of the valve apparatus 200 above and below the ball 226. This position is as shown in FIG. 11.

It should be noted that as the cage arms 230A and 230B are rotated to the left, the cage arm support ring 236 is permitted to rotate 180° therewith by means of the cage bearing 235, but the follow sleeve 233 remains stationary because of its splined interconnection with the lower housing 207.

During manipulation of the ball 226 from the open to the closed position, the resilient seal 225A always travels across the smooth outer surface of the ball 226 and the open end 226C.

After the conduit has been rotated sufficiently at the surface of the well to cause a 180° turn at the valve apparatus 200, the conduit is tested at the surface of the well by opening surface valves. If pressure is successfully bled off and out of the conduit, one is assured that the ball 226 has been manipulated from the open position shown in FIGS. 1 and 7 to the closed position shown in FIGS. 2 and 11.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A valve apparatus for use in a subterranean well and carriable on a fluid transmission conduit insertable therein, comprising: ball valve head means having camway slot means defined exteriorly thereon; valve seat means having camway ball means secured thereto and carriable in said camway slot means to pivot said valve head means on said seat means to shift said apparatus between open and closed positions in response to manipulation of said fluid transmission conduit.

2. The apparatus of claim 1 further comprising pin means carried within said valve head means for rotation of said valve head means in response to manipulation of said fluid transmission conduit.

3. The apparatus of claim 1 wherein said camway slot means is of a substantially semicircular configuration upon the periphery of said valve head means.

4. The apparatus of claim 2 wherein said camway slot means extends on one end to at least the plane of a diameter cut through the center of the valve head at a right angle to said pin means and on the other end to a point whereby a line from said point to the center of the valve head means defines an angle less than about 45° with the axis of said pin means.

5. The apparatus of claim 2 wherein the maximum distance from the center of the camway ball to a plane passing through said pin means and a center line of said valve means is when the valve head means is in open and closed positions.

6. The apparatus of claim 2 wherein the center line of said camway slot means lies in a plane defined by the center line of said pin means and the center line of the valve means when the valve head means is essentially positioned one-half way between the open and closed positions.

7. The apparatus of claim 1 whereby upon manipulation of the fluid transmission conduit a first amount defined at the valve means, the valve head means pivotally rotates a second amount for complete manipulation from one of open and closed position to the other of open and closed position.

8. The apparatus of claim 1 wherein said manipulation of said fluid transmission conduit is rotational manipulation.

* * * * *